US011000174B2

(12) United States Patent
Anim-Mensah et al.

(10) Patent No.: US 11,000,174 B2
(45) Date of Patent: May 11, 2021

(54) WAREWASHER AND ASSOCIATED SPRAY ARM ASSEMBLY

(71) Applicant: ILLINOIS TOOL WORKS INC., Glenview, IL (US)

(72) Inventors: Alexander R. Anim-Mensah, Miamisburg, OH (US); Mary E. Paulus, Sidney, OH (US); Michael T. James, Vandalia, OH (US); Shawn D. Waterman, Troy, OH (US); Cody Topp, Nashville, TN (US); Robert Petrick, Carnegie, PA (US); Vincenzo Violi, Cincinnati, OH (US); Philip Stone, Cincinnati, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 83 days.

(21) Appl. No.: 16/366,443

(22) Filed: Mar. 27, 2019

(65) Prior Publication Data

US 2019/0298144 A1 Oct. 3, 2019

Related U.S. Application Data

(60) Provisional application No. 62/649,774, filed on Mar. 29, 2018.

(51) Int. Cl.

| | |
|---|---|
| ***A47L 15/00*** | (2006.01) |
| ***A47L 15/42*** | (2006.01) |
| ***A47L 15/16*** | (2006.01) |

(52) U.S. Cl.

CPC ..... *A47L 15/0076* (2013.01); *A47L 15/16* (2013.01); *A47L 15/4259* (2013.01); *A47L 2401/26* (2013.01)

(58) Field of Classification Search

None

See application file for complete search history.

(56) References Cited

U.S. PATENT DOCUMENTS

| | | | | |
|---|---|---|---|---|
| 2,904,265 | A | 2/1936 | Blakeslee | |
| 3,141,618 | A * | 7/1964 | Haas | A47L 15/16 239/248 |

(Continued)

FOREIGN PATENT DOCUMENTS

| | | | |
|---|---|---|---|
| WO | WO 2008/100741 | 8/2008 | |
| WO | WO-2008100741 A1 * | 8/2008 | A47L 15/247 |

OTHER PUBLICATIONS

PCT, International Search Report and Written Opinion, International Application No. PCT/US2019/024209; dated Jun. 17, 2019, 14 pages.

(Continued)

*Primary Examiner* — Cristi J Tate-Sims

(74) *Attorney, Agent, or Firm* — Thompson Hine LLP

(57) ABSTRACT

A warewash machine includes a chamber for receiving wares, the chamber having at least one spray zone in which a liquid is recirculated from a tank to a spray tube assembly having a plurality of spray nozzles. The spray tube assembly includes a plurality of spray tubes, each including an input end and a distal end connected to a tube support, which has a fixed part and a cover movable between a closed and open positions. Each distal end has an opening that is covered in the closed position and uncovered, perhaps fully, in the open position. The tube support may include at least one latching assembly for holding the cover in the closed position. The cover and the access door may be cooperatively configured such that, when the cover is in the open position, the cover prevents the access door from moving to the closed operating position.

18 Claims, 5 Drawing Sheets

(56) References Cited

U.S. PATENT DOCUMENTS 4,735,222 A * 4/1988 Crane ..... A47L 15/241
134/172
5,927,616 A * 7/1999 Grise ..... A47L 15/4278
134/201
9,962,059 B2 5/2018 Kramer

OTHER PUBLICATIONS

Manual, FT1000-Series Dishwashers. 84 pages.

* cited by examiner

WAREWASHER AND ASSOCIATED SPRAY ARM ASSEMBLY

CROSS-REFERENCE TO RELATED APPLICATION

This application claims the benefit of U.S. Provisional Application No. 62/649,774, filed Mar. 29, 2018, the entire content of which is incorporated herein by reference.

TECHNICAL FIELD

This application relates generally to warewashers such as those used in commercial applications such as cafeterias and restaurants and, more particularly, to a spray arm assembly used in such warewashers.

BACKGROUND

Commercial warewashers commonly include a housing area which defines washing and rinsing zones for dishes, pots, pans and other wares. Heat recovery systems have been used to recover heat from the machine that would ordinarily be lost to the machine exhaust. A conveyance mechanism moves the wares through the zones of the machine where wash and rinse sprays are directed onto the wares. The sprays are commonly emitted from nozzles in spray tubes.

For a given spray zone, such as a wash or pre-wash zone or post-wash zone, it is common to provide a set of spray tubes which have an input side and a distal side. It is known to provide an assembly in which the distal sides of the spray tube set are selectively blocked by a sliding panel structure with openings. The panel structure is movable between an operating position (panel openings not aligned with tube ends) and a tube access position in which the panel openings align with the open ends of the spray tubes for the purpose of access and cleaning. However, this arrangement tends to have significant leakage out of the open ends of the spray tubes even when the sliding panel is in the tube access position, and portions of the panel still act as an obstruction to tube access even when the panel is in the tube access position.

It would be desirable to provide a spray tube assembly that reduces leakage and/or permits more effective access to the spray tubes.

SUMMARY

In one aspect, a warewash machine includes a chamber for receiving wares, the chamber having at least one spray zone in which a liquid is recirculated from a tank to a spray tube assembly having a plurality of spray nozzles for spraying on wares. The spray tube assembly includes a plurality of spray tubes, each spray tube including an input end fed by a liquid flow path and a distal end, each distal end being connected to a tube support having a fixed part and a cover movable between a closed position and an open position, each distal end having an opening that is covered in the closed position and uncovered in the open position. The tube support includes at least one latching assembly for holding the cover in the closed position.

In another aspect, a warewash machine includes a chamber for receiving wares and an access door movable between an open access position and a closed operating position, the chamber having at least one spray zone in which a liquid is recirculated from a tank to a spray tube assembly, the spray tube assembly having a plurality of spray nozzles for spraying the liquid on wares. The spray tube assembly includes a plurality of spray tubes, each spray tube including an input end fed by a liquid flow path and a distal end, each distal end being connected to a tube support having a fixed part and a cover movable between a closed position and an open position, each distal end having an opening that is covered in the closed position and uncovered in the open position. The cover and the access door are cooperatively configured such that, when the cover is in the open position, the cover prevents the access door from moving to the closed operating position.

In another aspect, a warewash machine includes a chamber for receiving wares, the chamber having at least one spray zone in which a liquid is recirculated from a tank to a spray tube assembly having a plurality of spray nozzles for spraying on wares. The spray tube assembly includes a plurality of spray tubes, each spray tube including an input end fed by a liquid flow path and a distal end, each distal end being connected to a tube support having a fixed part and a cover movable between a closed position and an open position, each distal end having an opening that is covered in the closed position and uncovered in the open position. The cover is pivotably connected to the fixed part, and the opening of each distal end is fully exposed when the cover is in the open position.

The details of one or more embodiments are set forth in the accompanying drawings and the description below. Other features, objects, and advantages will be apparent from the description and drawings, and from the claims.

DETAILED DESCRIPTION

Figure 1:
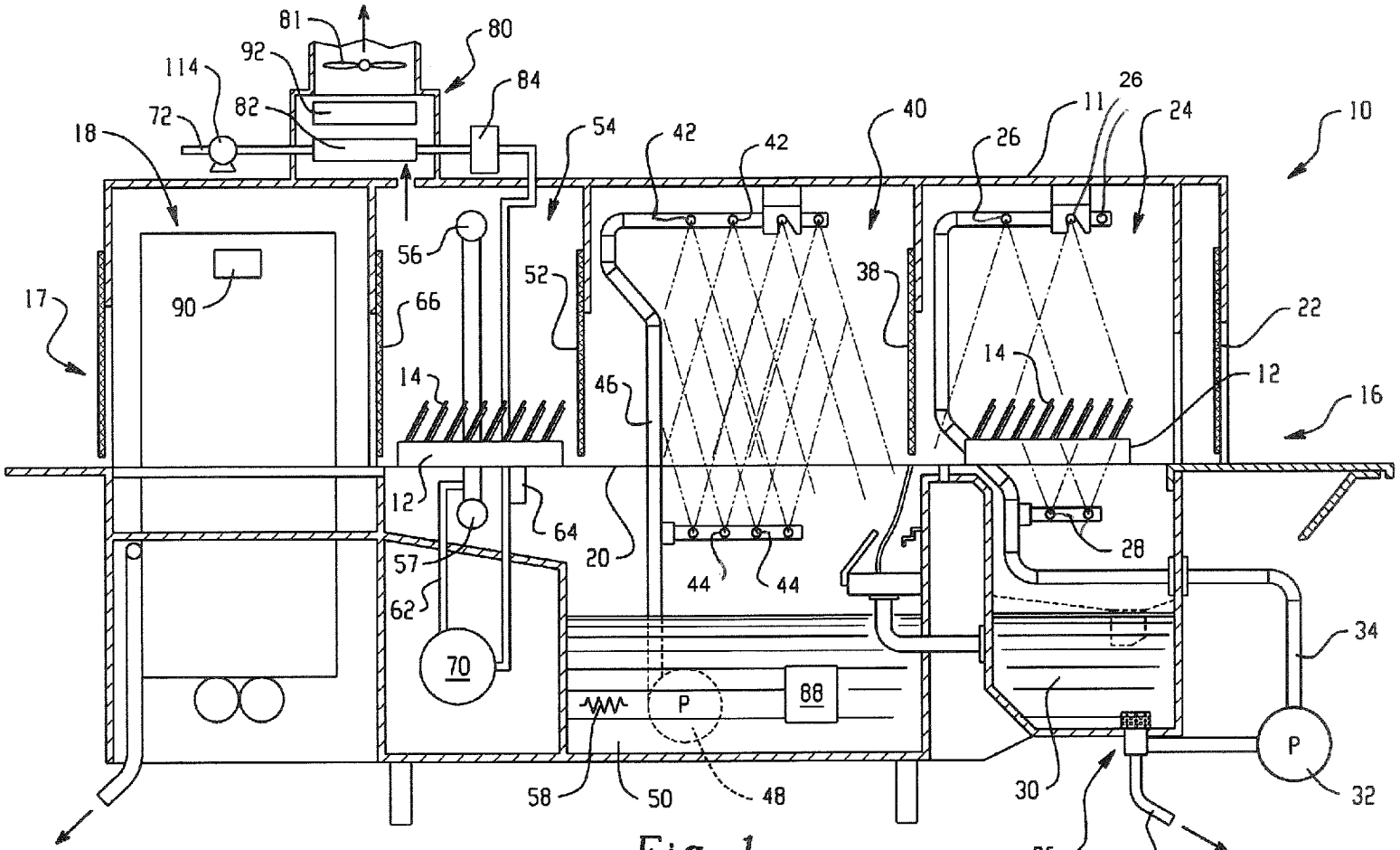
FIG. 1 is a schematic side elevation of one embodiment of a warewasher.

Referring to FIG. 1, an exemplary conveyor-type warewash machine, generally designated 10, is shown. Warewash machine 10 includes a housing 11 that can receive racks 12 of soiled wares 14 from an input side 16. The wares are moved through tunnel-like chambers from the input side 16 toward a blower dryer unit 18 at an opposite outlet end 17 of the warewash system by a suitable conveyor mechanism 20. Either continuously or intermittently moving conveyor mechanisms or combinations thereof may be used, depending, for example, on the style, model and size of the warewash system 10. Flight-type conveyors in which racks are not used are also possible. In the illustrated example, the racks 12 of soiled wares 14 enter the warewash system 10 through a flexible curtain 22 into a pre-wash chamber or zone 24 where sprays of liquid from upper and lower pre-wash spray tubes 26 and 28 above and below the racks, respectively, function to flush heavier soil from the wares using sprays from nozzles on the tubes. The liquid for this purpose comes from a tank 30 and is delivered to the tubes via a pump 32 and supply conduit 34. A drain structure 36 provides a single location where liquid is pumped from the tank 30 using the pump 32. Via the same drain structure, liquid can also be drained from the tank and out of the machine via drain path 37, for example, for a tank cleaning operation.

The racks proceed to a next curtain 38 into a main wash chamber or zone 40, where the wares are subject to sprays of cleansing wash liquid (e.g., typically water with detergent) from upper and lower wash spray tubes 42 and 44, with respective spray nozzles, these sprays being supplied through a supply conduit 46 by a pump 48, which draws from a main tank 50. A heater 58, such as an electrical immersion heater provided with suitable thermostatic controls (not shown), maintains the temperature of the cleansing liquid in the tank 50 at a suitable level. Not shown, but which may be included, is a device for adding a cleansing detergent to the liquid in tank 50. During normal operation, pumps 32 and 48 are continuously driven, usually by separate motors, once the warewash system 10 is started for a period of time.

The warewash system 10 may optionally include a power rinse (also known as post-wash) chamber or zone (not shown) that is substantially identical to main wash chamber 40. In such an instance, racks of wares proceed from the wash chamber 40 into the power rinse chamber, within which heated rinse water is sprayed onto the wares from upper and lower spray tubes.

The racks 12 of wares 14 exit the main wash chamber 40 through a curtain 52 into a final rinse chamber or zone 54. The final rinse chamber 54 is provided with upper and lower spray heads 56, 57 that are supplied with a flow of fresh hot water via pipe 62 running from a hot water booster 70 under the control of a solenoid valve (or alternatively any other suitable valve capable of automatic control). A rack detector 64 may be actuated when a rack 12 of wares 14 is positioned in the final rinse chamber 54 and through suitable electrical controls (e.g., the controller mentioned below), the detector causes actuation of, for instance, a solenoid valve to open and admit the hot rinse water to the spray heads 56, 57. The water then drains from the wares and is directed into the tank 50 by gravity flow. The rinsed rack 12 of wares 14 then exits the final rinse chamber 54 through curtain 66, moving into dryer unit 18, before exiting the outlet end 17 of the machine.

An exhaust system 80 for pulling hot moist air from the machine (e.g., via operation of a blower 81) may be provided. As shown, a cold water input of flow path 72 (flow controlled by pump 114 or a valve) may run through a waste heat recovery unit 82 (e.g., a fin-and-tube heat exchanger through which the incoming water flows, though other variations are possible) to recover heat from the exhaust air flowing across and/or through the unit 82. The water line or flow path 72 then runs through one or more condensers 84 (e.g., in the form of plate heat exchangers or shell-and-tube heat exchangers, though other variations are possible), before delivering the water to the booster 70 for final heating. A condenser 88 may be located in the wash tank and a condenser 90 may be located in the blower dryer unit 18. A second waste heat recovery unit 92 may also be provided. Of course, machines that do not include waste heat recovery are also possible.

Figure 2:
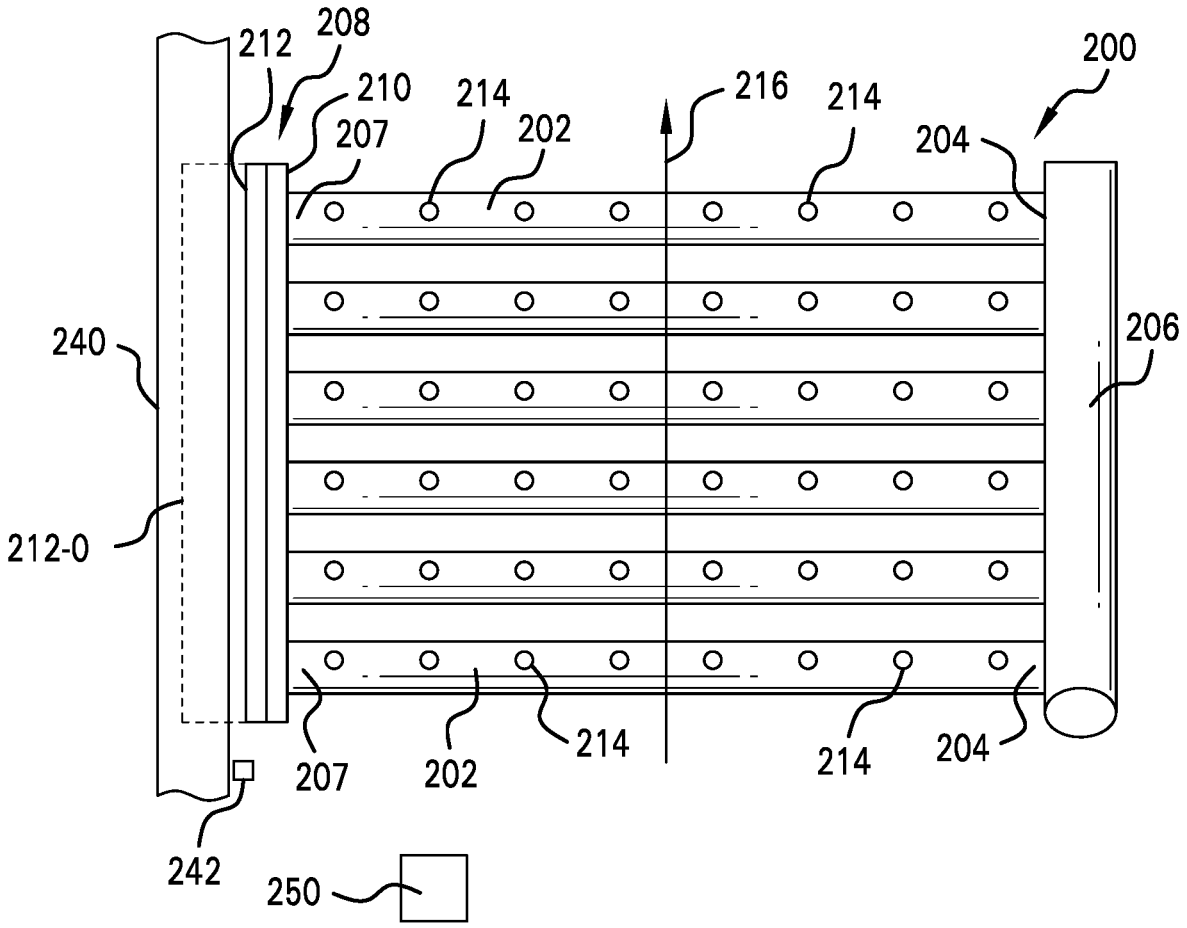
FIG. 2 is a bottom plan view of one embodiment of a spray tube assembly.

Referring now to FIG. 2, an exemplary bottom view of an upper spray tube assembly 200 is shown in which multiple spray tubes 202 have input ends 204 connected to a common feed manifold 206 and distal ends 207 connected to a common support frame 208 that includes a fixed part 210 (e.g., fixed in relation to the ends of the tubes) and a movable part 212. The moveable part 212 may be pivotably connected to the fixed part 210. Each of the spray tubes 202 includes multiple nozzles 214 as shown. The spray tubes may typically extend across the ware conveyance direction 216 of a conveyor warewash machine. Spray tubes 202 may be exemplary of the spray tubes 26 or 42 mentioned above, and similar spray tube assemblies may be used for the tubes below the ware conveyor (e.g., with nozzles pointed upward instead of downward). Each distal end 207 may have an opening 217 (best shown in FIG. 3) that is completely covered when the moveable part 212 is in the closed position and fully open when the moveable part 212 is in the open position. Thus, when the machine is not in operation, the entire inner surface of each spray tube 202 may be accessed for purposes such as cleaning. In other embodiments, the opening 217 may be only partially open when the moveable part 212 is in the open position.

Figure 3:
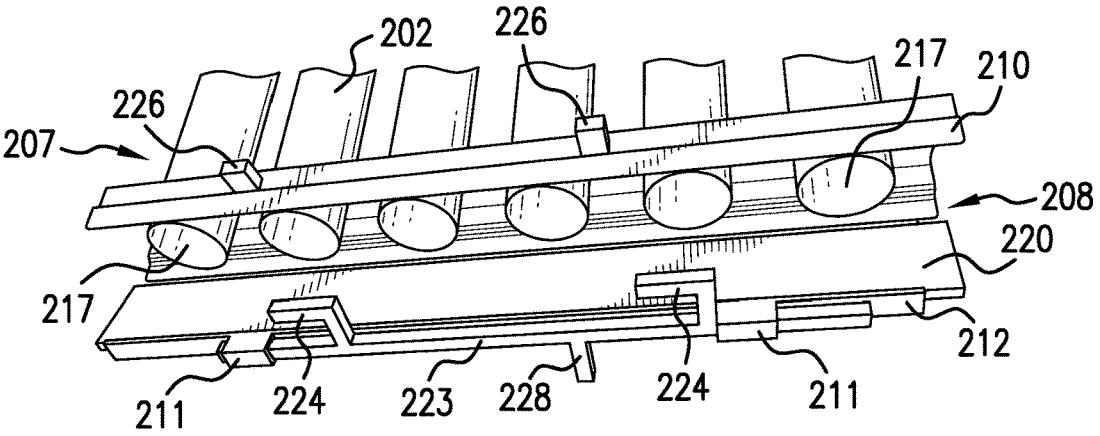
FIG. 3 is a partial end perspective of a spray tube assembly support frame with cover in open position.
Figure 4:
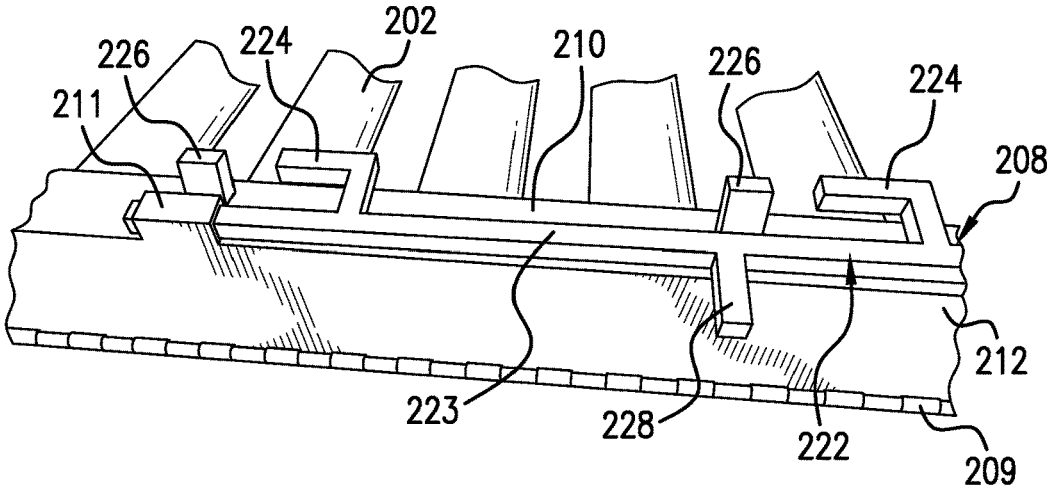
FIG. 4 is a partial end perspective of the assembly of FIG. 3 with cover in closed position.
Figure 5:
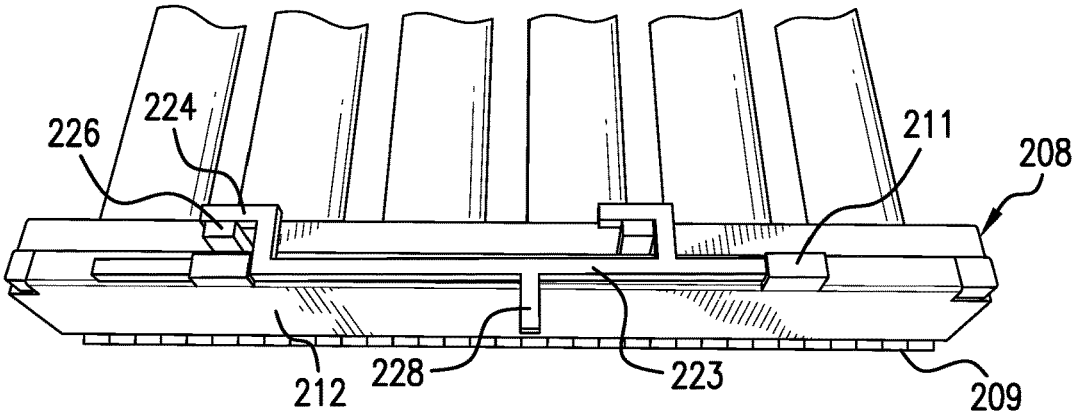
FIG. 5 is a partial end perspective of the assembly of FIG. 3 with cover in closed and latched position.

Referring to FIGS. 3-5, in one embodiment the movable part 212 of the support frame 208 is pivotably connected to the fixed part 210 (e.g., by one or more hinges 209) and includes a liner material 220 (also referred to as a "resilient member") selected to seal the ends of the spray tubes 202 when the movable part 212 is in the closed position (FIG. 5). The movable part may be referred to as a cover or cover part. The hinged connection could be achieved in numerous ways (e.g., with hinges that do not permit full separation of the two parts 210 and 212 or with hinges that do allow full separation of the two parts 210 and 212). The liner material or resilient member may, for example, be a polymer material with at least some give or flex that assures a good mating contact around the entirety of the open end edge of each tube. Here, a continuous liner material is used, but in other examples discrete pieces of liner material may be used (e.g., one piece aligned with, or alignable with, the end of each tube). When the movable part 212 is moved to closed position the part 212 may be latched into the closed position. Here the latching occurs by a sliding bar latch system 222 with L-catches 224 that engage respective posts 226 on the fixed part 210. An elongated body 223 of the sliding bar is captured by and movable within spaced apart channel members 211. A handle 228 may be provided to facilitate manual sliding. The latching causes the liner material 220 to be pressed against the distal ends 207 when the moveable part 212 is in the closed position. In some embodiments, the liner material 220 may fully seal the distal ends 207 when the moveable part 212 is in the closed position.

Figure 6:
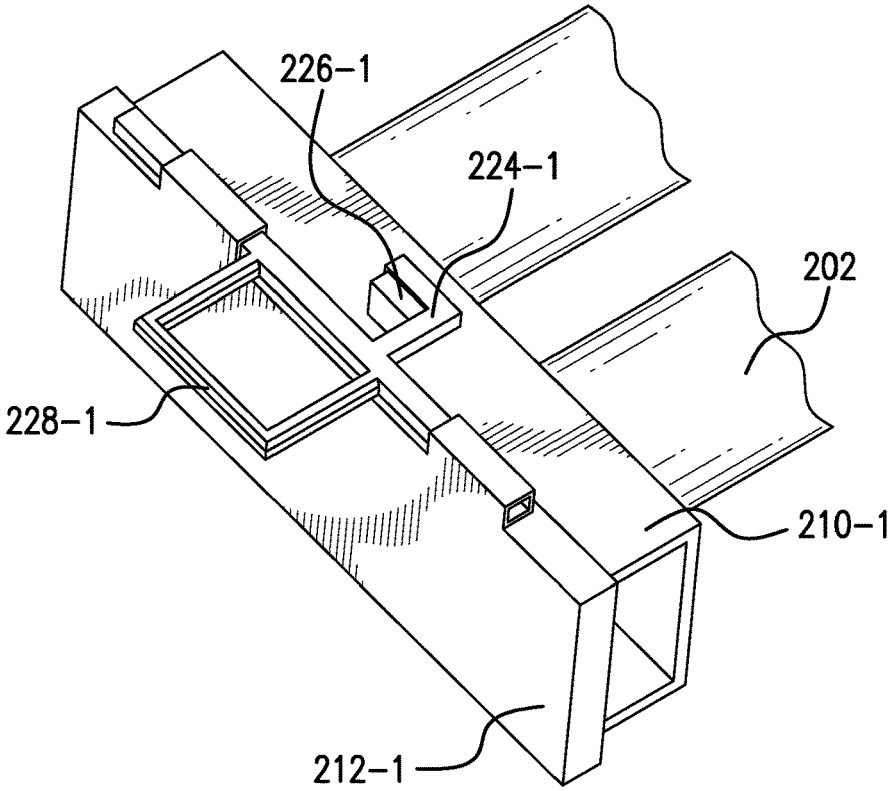
FIG. 6 shows a partial end perspective of a spray tube assembly support frame with an alternative latch system.

In another assembly shown in FIG. 6, the movable part 212-1 latches to the fixed part 210-1 by a single latch formed by catch 224-1 and post 226-1 and with a U-shaped handle 228-1.

Figure 7:
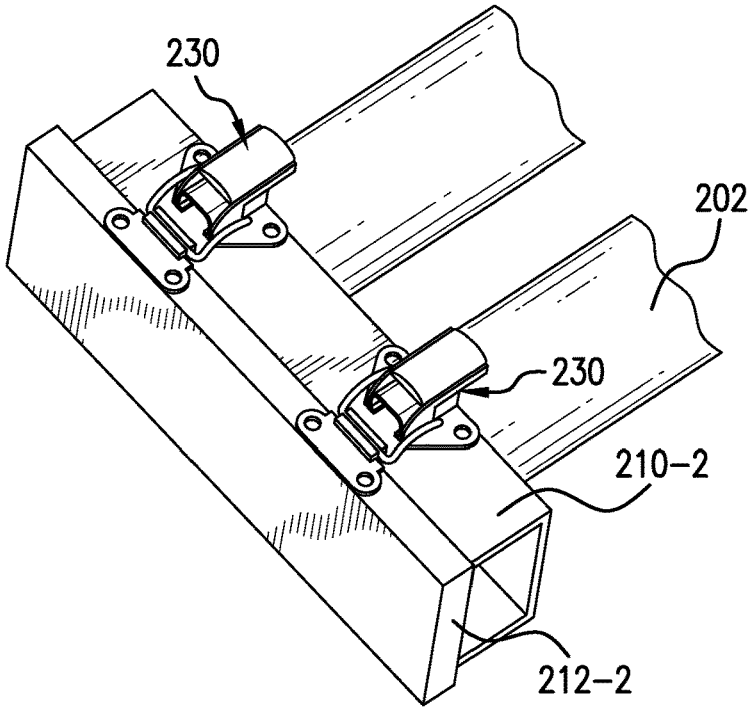
FIG. 7 shows a partial end perspective of a spray tube assembly support frame with an alternative latch system.

In another assembly shown in FIG. 7, over-center latches 230 with spring-bias are used to latch the movable cover part 212-2 in the closed position adjacent the fixed part 210-2.

Figure 8:
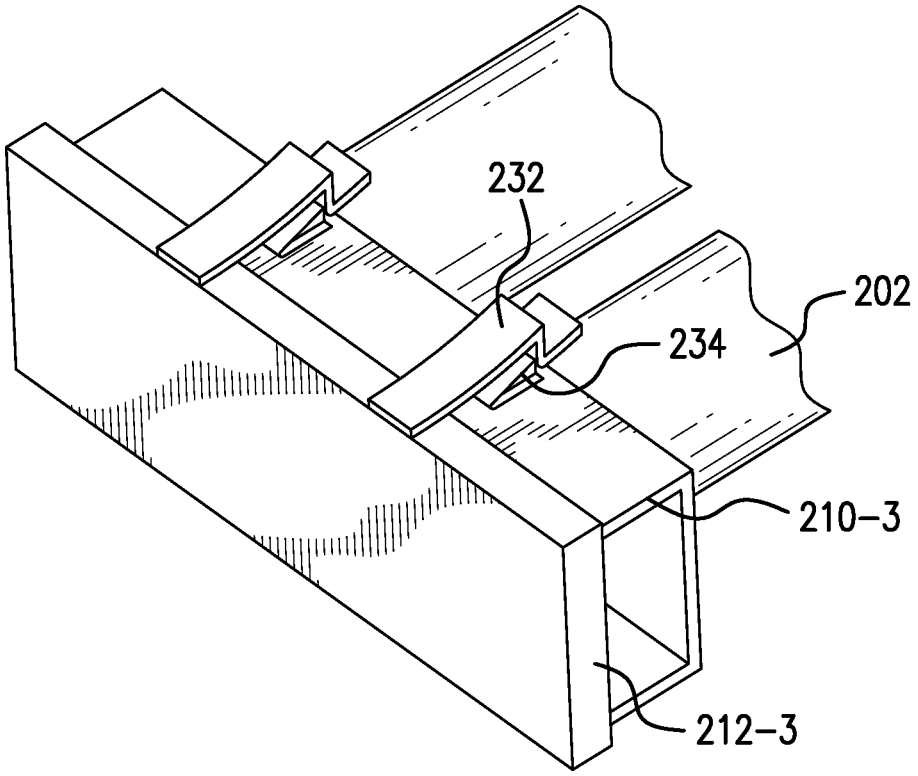
FIG. 8 shows a partial end perspective of a spray tube assembly support frame with an alternative latch system.

In another assembly shown in FIG. 8, spring/flex catch parts 232 on the movable part 212-3 engage ramped tab parts 234 on the fixed part 210-3. In this assembly, when the movable part 212-3 is pivoted to the closed position, the catch parts 232 automatically flex up and slide over the tab parts 234 during closure and then flex back down and seat behind the tab parts 234 when closure is complete.

Referring again to FIG. 2, in some systems an access door 240 of the warewash machine may be movable (e.g., pivotable or slidable) between a closed operating position nearer the support frame 208 and an open access position away from the support frame 208, where the closed operating position is shown in FIG. 2. A representative swung open position of the movable part or cover 212 is shown by dashed line form 212-0 and, as shown, would interfere with movement of the access door 240 to its closed operating position. In such an embodiment, the movable cover 212 presents a mechanical obstacle to closure of the door 240 unless the cover 212 is moved into the intended closed position for machine operation. This arrangement helps assure that the cover 212 is properly positioned when the machine is operating. In some cases, the machine may also include a door sensor 242 to detect if the door 240 is closed and to prevent the machine from running if the door 240 is not closed (e.g., via a machine controller 250). Thus, if the movable cover 212 is open and obstructing closure of the door 240, the machine will not run and the controller may be configured to issue an operator alert (e.g., to an interface) to instruct the operator to close the door and/or check for closure of the spray tube cover 212.

The subject spray tube assemblies provide advantages, including (i) opportunity to seal off individual tubes on a tube assembly once the movable cover is closed, (ii) opportunity to have full access to the open end of each individual tube once the cover is opened, (iii) use of a sliding latch mechanism to secure the movable cover, (iv) use of a spring loaded latching mechanism to secure the movable cover and/or (v) use of a flexing latch mechanism to secure the movable cover.

It is to be clearly understood that the above description is intended by way of illustration and example only and is not intended to be taken by way of limitation, and that changes and modifications are possible. For example, although the illustrated embodiments contemplate a pivotable connection between the lower edges of the movable part and the fixed part, the pivotable connection could be along the top or along either side. Likewise, the location of the latching assembly could vary. Accordingly, other embodiments are contemplated and modifications and changes could be made without departing from the scope of this application.

What is claimed is:

1. A warewash machine for washing wares, comprising:

a chamber for receiving wares, the chamber having at least one spray zone in which a liquid is recirculated from a tank to a spray tube assembly, the spray tube assembly having a plurality of spray nozzles for spraying the liquid on wares;

wherein the spray tube assembly includes a plurality of spray tubes, each spray tube including an input end fed by a liquid flow path and a distal end, each distal end being connected to a tube support having a fixed part and a single cover movable between a closed position and an open position, each distal end having an opening that is covered by the single cover in the closed position and uncovered in the open position; and wherein the tube support includes at least one latching assembly for holding the single cover in the closed position.

2. The warewash machine of claim 1, wherein the single cover includes at least one resilient member configured to engage and at least partially seal the distal ends when the single cover is in the closed position.

3. The warewash machine of claim 2, wherein the at least one latching assembly causes the at least one resilient member to be pressed against the distal ends when the single cover is in the closed position.

4. The warewash machine of claim 1, wherein the single cover is pivotably connected to the fixed part.

5. The warewash machine of claim 1, wherein the at least one latching assembly comprises a sliding bar latch system having at least one post and at least one L-catch.

6. The warewash machine of claim 1, wherein the at least one latching assembly comprises at least one over-center latch.

7. The warewash machine of claim 1, wherein the at least one latching assembly comprises at least one flex latch having at least one fixed part and at least one catch part configured to engage the at least one fixed part.

8. The warewash machine of claim 1, wherein the opening of each distal end is fully exposed when the single cover is in the open position.

9. The warewash machine of claim 1, wherein the warewash machine further comprises an access door movable between an open access position and a closed operating position, the single cover positioned proximate the access door, wherein the single cover and the access door are cooperatively configured such that, when the single cover is in the open position, the single cover physically interferes with the access door moving from the open access position to the closed operating position.

10. The warewash machine of claim 9, further comprising a door sensor to detect if the access door is in the closed operating position.

11. A warewash machine for washing wares, comprising:

a chamber for receiving wares and an access door movable between an open access position and a closed operating position, the chamber having at least one spray zone in which a liquid is recirculated from a tank to a spray tube assembly, the spray tube assembly having a plurality of spray nozzles for spraying the liquid on wares;

wherein the spray tube assembly includes a plurality of spray tubes, each spray tube including an input end fed by a liquid flow path and a distal end, each distal end being connected to a tube support having a fixed part and a cover movable between a closed position and an open position, each distal end having an opening that is covered in the closed position and uncovered in the open position; and wherein the cover and the access door are cooperatively configured such that, when the cover is in the open position, the cover physically interferes with the access door moving from the open access position to the closed operating position.

12. The warewash machine of claim 11, wherein the cover includes at least one resilient member configured to engage and at least partially seal the distal ends when the cover is in the closed position.

13. The warewash machine of claim 11, further comprising a door sensor to detect if the access door is in the closed operating position.

14. The warewash machine of claim 11, wherein the opening of each distal end is fully exposed when the cover is in the open position.

15. The warewash machine of claim 11, wherein the cover is pivotably connected to the fixed part.

16. The warewash machine of claim 11, wherein:

the cover includes at least one resilient member configured to engage and at least partially seal the distal ends when the cover is in the closed position;

the opening of each distal end is fully exposed when the cover is in the open position.

17. The warewash machine of claim 16, further comprising at least one latching assembly that causes the at least one resilient member to be pressed against the distal ends when the cover is in the closed position.

18. A warewash machine for washing wares, comprising:

a chamber for receiving wares, the chamber having at least one spray zone in which a liquid is recirculated from a tank to a spray tube assembly, the spray tube assembly having a plurality of spray nozzles for spraying the liquid on wares;

wherein the spray tube assembly includes a plurality of spray tubes, each spray tube including an input end fed by a liquid flow path and a distal end, each distal end being connected to a tube support having a fixed part and a cover movable between a closed position and an open position, each distal end having an opening that is covered in the closed position and uncovered in the open position;

wherein the tube support includes at least one latching assembly for holding the cover in the closed position;

wherein the movable cover includes at least one resilient member configured to engage and at least partially seal the distal ends when the cover is in the closed position;

wherein the at least one latching assembly causes the at least one resilient member to be pressed against the distal ends when the cover is in the closed position.

* * * * *